US006915686B2

(12) United States Patent
Baustad

(10) Patent No.: US 6,915,686 B2
(45) Date of Patent: Jul. 12, 2005

(54) DOWNHOLE SUB FOR INSTRUMENTATION

(75) Inventor: Terje Baustad, Stavanger (NO)

(73) Assignee: Optoplan A.S., Trondheim (NO)

( * ) Notice: Subject to any disclaimer, the term of this patent is extended or adjusted under 35 U.S.C. 154(b) by 0 days.

(21) Appl. No.: 10/364,311

(22) Filed: Feb. 11, 2003

(65) Prior Publication Data

US 2004/0154390 A1 Aug. 12, 2004

(51) Int. Cl.[7] ..... E21B 44/00

(52) U.S. Cl. ..... 73/152.46; 73/152.36; 73/152.45

(58) Field of Search ..... 73/152.46, 152.01, 73/152.45, 152.36, 152.5

(56) References Cited

U.S. PATENT DOCUMENTS

| | | | | | |
|---|---|---|---|---|---|
| 4,445,578 | A | * | 5/1984 | Millheim | 175/45 |
| 5,767,411 | A | | 6/1998 | Maron | 73/705 |
| 5,803,186 | A | * | 9/1998 | Berger et al. | 175/50 |
| 5,844,132 | A | * | 12/1998 | Fabret et al. | 73/152.45 |
| 5,844,667 | A | | 12/1998 | Maron | 356/35.5 |
| 5,877,426 | A | | 3/1999 | Hay et al. | 73/733 |
| 5,892,860 | A | | 4/1999 | Maron et al. | 385/12 |
| 5,925,879 | A | | 7/1999 | Hay | 250/227.14 |
| 5,945,665 | A | | 8/1999 | Hay | 250/227.14 |
| 5,973,317 | A | | 10/1999 | Hay | 250/227.14 |
| 5,986,749 | A | | 11/1999 | Wu et al. | 356/73.1 |
| 5,987,197 | A | | 11/1999 | Kersey | 385/24 |
| 6,009,216 | A | | 12/1999 | Pruett et al. | 385/12 |
| 6,016,702 | A | | 1/2000 | Maron | 73/705 |
| 6,026,915 | A | * | 2/2000 | Smith et al. | 175/50 |
| 6,047,239 | A | * | 4/2000 | Berger et al. | 702/9 |
| 6,056,059 | A | * | 5/2000 | Ohmer | 166/313 |
| 6,072,567 | A | | 6/2000 | Sapack | 356/32 |
| 6,082,455 | A | | 7/2000 | Pringle et al. | 166/250.15 |
| 6,118,914 | A | | 9/2000 | Davis et al. | 385/37 |
| 6,157,893 | A | * | 12/2000 | Berger et al. | 702/9 |
| 6,175,108 | B1 | | 1/2001 | Jones et al. | 250/227.14 |
| 6,179,066 | B1 | * | 1/2001 | Nasr et al. | 175/45 |
| 6,191,414 | B1 | | 2/2001 | Ogle et al. | 250/227.14 |
| 6,227,114 | B1 | | 5/2001 | Wu et al. | 102/201 |
| 6,229,827 | B1 | | 5/2001 | Fernald et al. | 372/20 |
| 6,230,557 | B1 | * | 5/2001 | Ciglenec et al. | 73/152.01 |
| 6,233,374 | B1 | | 5/2001 | Ogle et al. | 385/13 |
| 6,249,624 | B1 | | 6/2001 | Putnam et al. | 385/37 |
| 6,252,656 | B1 | | 6/2001 | Wu et al. | 356/73.1 |

(Continued)

OTHER PUBLICATIONS

W. Furlow, "Intelligent Wells: Low–End and High–End Systems and How They Work—Where is the Technology Going?" Offshore Magazine, p. 96–110 (Apr. 2001).
Intelligent Well Completion: The Next Steps, W. Magazine, pp. 18–20 (Sep. 2002).
Intelligent Completions: Potential, But Some Hurdles, Drilling Contractor, pp. 40–42 (Mar./Apr. 2001).
U.S. Appl. No. 10/375,614, filed Feb. 27, 2003, G. Vold.

*Primary Examiner*—Hezron Williams
*Assistant Examiner*—Rodney Frank
(74) *Attorney, Agent, or Firm*—Moser, Patterson & Sheridan

(57) ABSTRACT

A downhole sub for instrumentation, such as a fiber optic sensor. The sub is configured to be connected to a string of pipe, such as a string of tubing. The sub first comprises an essentially concentric tubular body. The tubular body has an inner diameter that generally conforms to the inner diameter of the tubing string. A recess is formed within the wall of the tubular body. Next, the sub comprises a gauge housing that is received within the recess of the tubular body. The gauge housing includes a plate portion that is exposed to fluids within the production tubing. The gauge housing further includes a side bore that receives a sensor. One or more gauge housing ports are pre-fabricated into the gauge housing to provide fluid communication between the inner bore of the production tubing and the side bore of the gauge housing. The entire sub is preferably self-contained without any elastomers or metal-to-metal seals.

18 Claims, 6 Drawing Sheets

U.S. PATENT DOCUMENTS 6,268,911 B1 7/2001 Tubel et al. ..... 356/72
6,271,766 B1 8/2001 Didden et al. ..... 340/853.1
6,274,863 B1 8/2001 Kersey ..... 250/227.14
6,279,392 B1 * 8/2001 Shahin et al. ..... 73/152.52
6,279,660 B1 8/2001 Hay ..... 166/336
6,298,184 B1 10/2001 Putnam et al. ..... 385/37
6,305,227 B1 10/2001 Wu et al. ..... 73/705
6,310,990 B1 10/2001 Putnam et al. ..... 385/12
6,317,555 B1 11/2001 Maron et al. ..... 385/137
6,321,007 B1 11/2001 Sanders ..... 385/37
6,346,702 B1 2/2002 Davis et al. ..... 250/227.14
6,351,987 B1 3/2002 Winston et al. ..... 73/53.01
6,354,147 B1 3/2002 Gysling et al. ..... 73/61.79
6,363,089 B1 3/2002 Fernald et al. ..... 372/20
6,403,949 B1 6/2002 Davis et al. ..... 250/227.27
6,404,961 B1 6/2002 Bonja et al. ..... 385/109
6,439,055 B1 8/2002 Maron et al. ..... 73/705
6,443,226 B1 9/2002 Diener et al. ..... 166/241.6
6,445,868 B1 9/2002 Grunbeck et al. ..... 385/138
6,450,037 B1 9/2002 McGuinn et al. ..... 73/705
6,452,667 B1 9/2002 Fernald et al. ..... 356/73.1
6,453,108 B1 9/2002 Sirkis ..... 385/136
6,456,771 B1 9/2002 Sanders ..... 385/124
6,457,521 B1 10/2002 Langseth et al. ..... 166/264
6,462,329 B1 10/2002 Davis et al. ..... 250/227.14
6,463,813 B1 10/2002 Gysling ..... 73/862.59
6,464,011 B2 10/2002 Tubel ..... 166/313
6,466,716 B1 10/2002 Ogle ..... 385/37
6,470,036 B1 10/2002 Bailey et al. ..... 372/20
6,474,152 B1 11/2002 Mullins et al. ..... 73/152.22
6,564,883 B2 * 5/2003 Fredericks et al. ..... 175/50
6,729,399 B2 * 5/2004 Follini et al. ..... 166/264

* cited by examiner

DOWNHOLE SUB FOR INSTRUMENTATION

BACKGROUND OF THE INVENTION

1. Field of the Invention

The present invention relates generally to oilfield operations. More particularly, the present invention pertains to systems and methods for monitoring downhole conditions in wellbores, including fluid characteristics and formation parameters, using sensors, gauges and other instrumentation.

2. Description of the Related Art

During the life of a producing hydrocarbon well or an injection well, it is sometimes desirable to monitor conditions in situ. Recently, technology has enabled well operators to monitor conditions within a wellbore by installing permanent monitoring systems downhole. The monitoring systems permit the operator to monitor multiphase fluid flow, as well as pressure and temperature. Downhole measurements of pressure, temperature and fluid flow play an important role in managing oil and gas or other sub-surface reservoirs.

Historically, permanent monitoring systems have used electronic components to provide pressure, temperature, flow rate and water fraction on a real-time basis. These monitoring systems employ temperature gauges, pressure gauges, acoustic sensors, and other instruments, or "sondes," disposed within the wellbore. Such instruments are either battery operated, or are powered by electrical cables deployed from the surface.

Historically, the monitoring systems have been configured to provide an electrical line that allows the measuring instruments, or sensors, to send measurements to the surface. Recently, fiber optic sensors have been developed which communicate readings from the wellbore to optical signal processing equipment located at the surface. The fiber optic sensors may be variably located within the wellbore. For example, optical sensors may be positioned to be in fluid communication with the housing of a submersible electrical pump. Such an arrangement is taught in U.S. Pat. No. 5,892,860, issued to Maron, et al., in 1999. The '860 patent is incorporated herein in its entirety, by reference. Fiber optic sensors may also be disposed along the tubing within a wellbore. In either instance, a fiber optic cable is run from the surface to the sensing apparatus downhole. The fiber optic cable transmits optical signals to an optical signal processor at the surface.

FIG. 1 presents a cross-section of a wellbore 50 which has been completed for the production/injection of effluents. The wellbore 50 extends downward into an earth formation 55. It can be seen that the wellbore 50 has a string of casing 15 that has been cemented into place. A column of cement 20 is cured between the casing string 15 and the earth formation 55. It can also be seen that a liner string 30 has been hung off of the casing 15 and extends into the pay zone. One or more intermediate strings of casing 15' are optionally deployed between the initial string of casing 15 and the lowest liner 30. At its lower end, the liner string 30 is perforated. Perforations 35 provide fluid communication between the earth formation 55 and the internal bore of the liner 30. Alternatively, the wellbore 50 may be completed as an open hole.

Also visible in the wellbore 50 of FIG. 1 is a tubing string 35. The tubing string 35 may be a production string or an injection string. The tubing string 55 extends from the surface to the pay zone depth. The tubing string 35 is hung from a surface assembly, shown schematically at 60. An example of such a surface assembly 60 is a production assembly for receiving hydrocarbons. A packer 40 is shown affixed to the tubing string 35 so as to seal off the annular region between the tubing string 35 and the surrounding liner 30. In this way, production fluids are directed to the surface production assembly 60.

The wellbore 50 of FIG. 1 also includes a submersible electrical pump 45. The pump 45 is disposed at the lower end of the tubing 35. The pump 45 may be an electrical submersible pump, or may be driven mechanically by sucker rods (not shown). The pump 45 serves as an artificial lift mechanism, driving production fluids from the bottom of the wellbore 50 to the surface assembly 60. Of course, it is understood that the formation 55 may be able to produce without artificial lifting means.

The wellbore 50 of FIG. 1 has a downhole monitoring system 100 positioned therein. The monitoring system 100 is designed to operate through one or more sensors connected to a cable 136. An example of such a sensor is a fiber optic sensor. The sensor is positioned within a tubular side mandrel, shown schematically at 110. It can be seen that the mandrel 110 is disposed in series with the tubing string 35 above or below the packer 40. The mandrel is configured to hold one or more sensors (shown more fully at 10 in FIG. 2). More specifically, the mandrel 110 includes a side pocket (shown at 112 in FIG. 2). The sensor 10 may define a pressure gauge, a temperature gauge, an acoustic sensor, or other sondes. The sensor may be either electrical or fiber optic.

FIG. 2 presents an enlarged cutaway view of the tubular side mandrel 110. The mandrel 110 has a lower end 116 and an upper end 118. The lower end 116 defines a male pin, while the upper end 118 defines a female collar. Each end 116, 118 is arranged to threadedly connect to a respective joint of tubing 55 (not shown in FIG. 2). A clamp 120 is placed around the mandrel 110. The clamp 120 is provided to hold one or more cables 136. In one example, the cable 136 is a fiber optic cable.

As noted, the mandrel 110 includes a side pocket 112. The side pocket 112 defines an eccentric portion extending to a side of the mandrel 110. The side pocket 112 houses the sensor 10. In the arrangement of FIG. 2, the sensor 10 is further held within the side pocket 112 by a separate gauge housing 114 having a port 115 to provide hydraulic communication between the main bore of the mandrel 110 and the sensor 10.

The sensor 10 is in optical communication with the optical cable 136. The cable 136 extends through openings (not shown) in the mandrel side pocket 112 and the gauge housing 114. In the fuller wellbore view of FIG. 1, it can be seen that the optical cable 136 extends upward from the sensor 10 within the mandrel 110, to the surface. In the example of FIG. 1, the cable 136 connects to optical signal processing equipment 132 that is located at the surface of the wellbore 50. The optical signal processing equipment 132 includes an excitation light source, shown schematically at 134. Excitation light may be provided by a broadband light source 134, such as a light emitting diode (LED) located within the optical signal processing equipment 132. The optical signal processing equipment 132 will also include appropriate equipment for delivery of signal light to the sensor(s) 10, e.g., Bragg gratings and a pressure gauge. Additionally, the optical signal processing equipment 132 includes appropriate optical signal analysis equipment for analyzing the return signals from the Bragg gratings (not shown).

The fiber optic cable 136 is not shown in cross-section. However, it is understood that where the cable 136 is a fiber optic cable, it will be designed so as to deliver pulses of optic energy from the light source 134 to the sensor(s) 10. The fiber optic cable 136 is also designed to withstand the high temperatures and pressures prevailing within a hydrocarbon wellbore 50. Preferably, the fiber optic cable 136 includes an internal optical fiber (not shown) which is protected from mechanical and environmental damage by a surrounding capillary tube (also not shown). The capillary tube is made of a high strength, rigid-walled, corrosion-resistant material, such as stainless steel. The tube is attached to the sensor 10 by appropriate means, such as threads, a weld, or other suitable method. The optical fiber 12 contains a light guiding core (not shown) which guides light along the fiber. The core preferably employs one or more Bragg gratings to act as a resonant cavity and to also interact with the sonde 10.

Construction and operation of a fiber optic sensor 10, in one embodiment, is described in the '860 patent, mentioned above. In that patent, it is explained that each Bragg grating is constructed so as to reflect a particular wavelength or frequency of light being propagating along the core, back in the direction of the light source from which it was launched. Each of the particular frequencies is different from the other, such that each Bragg grating reflects a unique frequency.

Returning to FIG. 2, it can be seen that the configuration of the prior art mandrel 110 involved an eccentric design which incorporates a side pocket 112. The use of the side pocket 112 requires that the OD of the mandrel 110 be increased so as to accommodate the geometry of the side pocket 112. Furthermore the conventional mandrel/sensor systems have several potential leak paths between the tubing 55 and the surrounding liner 30. Therefore, a new design is needed for a tool to house sensing instrumentation. There is also a need for a sensing apparatus that decreases the possibility of leaks by reducing leak paths. Further, there is a need for a sub that more easily conforms to the dimensions of the surrounding liner and does not unduly restrict the flow of fluids therethrough.

SUMMARY OF THE INVENTION

The present invention generally provides a downhole sub for instrumentation. The sub is configured to be threadedly connected to a string of pipe, such as a string of production tubing. The sub first comprises a tubular body. The tubular body comprises a wall having an inner diameter and an outer diameter. The dimensions of the inner diameter generally conform to those of the inner diameter of the production string. Next, the sub comprises a gauge housing. The gauge housing attaches to the tubular body at manufacture. A recess is formed in the wall of the tubular body for receiving the gauge housing.

The purpose of the gauge housing is to house a downhole sensor. The sensor may be either fiber optic or electrical. The gauge housing includes a plate portion that is exposed to fluids within the production tubing. This permits the downhole sensor to sense a condition within the production string. The plate portion of the gauge housing faces the bore of the tubular body. One or more gauge housing ports are fabricated into the gauge housing to provide hydraulic communication between the inner bore of the production tubing and the side bore of the gauge housing. Alternatively, a path may be manufactured to expose the gauge sensor plate to external tubing pressure only. Finally, the gauge housing includes a side bore that receives a surface cable.

An enlarged outer diameter portion is also provided about the tubular body. The enlarged outer diameter portion is configured to approximate the size of the collars being used for the production tubing. In this arrangement, the recess for receiving the gauge housing is fabricated into the enlarged outer diameter portion of the tubular body. The use of an enlarged outer diameter portion serves to mechanically protect the gauge housing as the sub is lowered into the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 3:
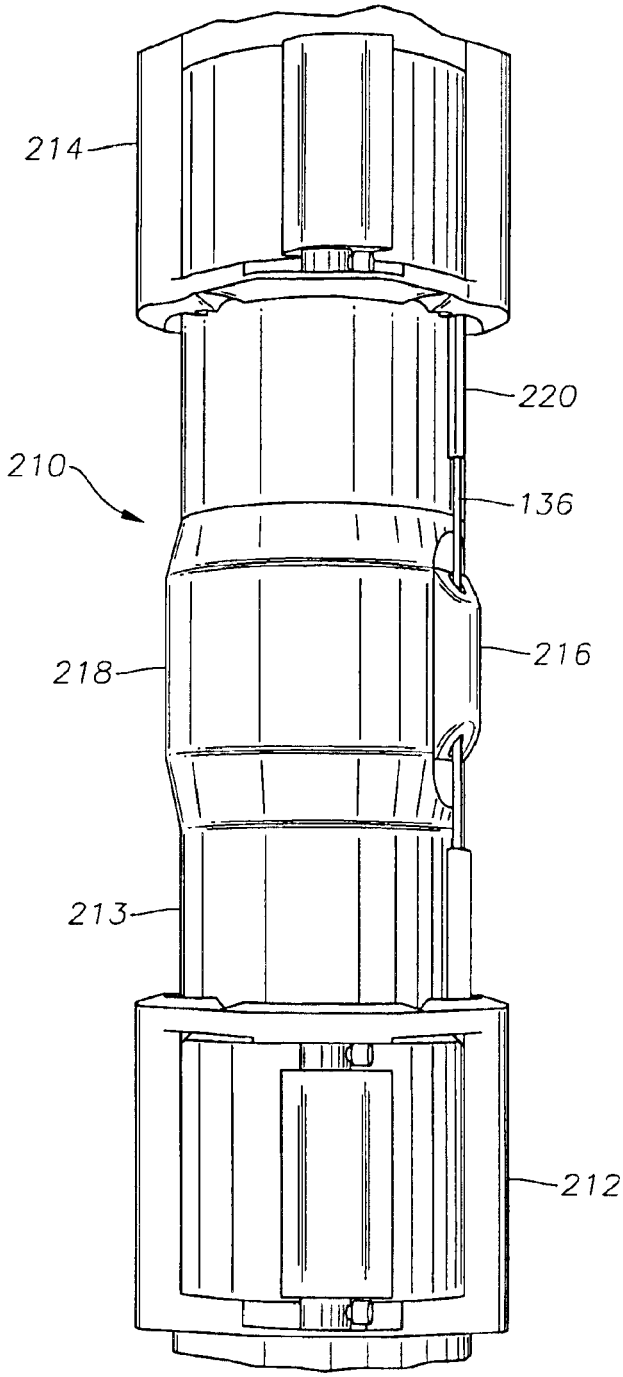
FIG. 3 presents a perspective view of the downhole sub of the present invention, in one embodiment. The wall of the downhole sub is designed to receive a sensor, such as a pressure gauge or other sonde.

FIG. 3 presents a perspective view of the downhole sub 210 of the present invention, in one embodiment. The downhole sub 210 is designed to receive instrumentation, such as a pressure gauge or other sonde. An exemplary sensor is shown at 10 in FIG. 6, as will be discussed below. For purposes of this disclosure, the term instrumentation includes any type of sensor, gauge or sonde.

The downhole sub 210 first comprises a tubular body 213. The tubular body 213 may be of any essentially concentric cross-sectional shape, but preferably is generally circular. The tubular body 213 has an inner diameter that generally conforms to the inner diameter of the tubing string 55. In this way, the flow of effluents through the sub 210 is not impeded en route. Further, the concentric cross-sectional shape allows the outer diameters of the sub body 213 to be minimized, further enhancing the volumetric flow of effluents in the annulus space.

Figure 1:
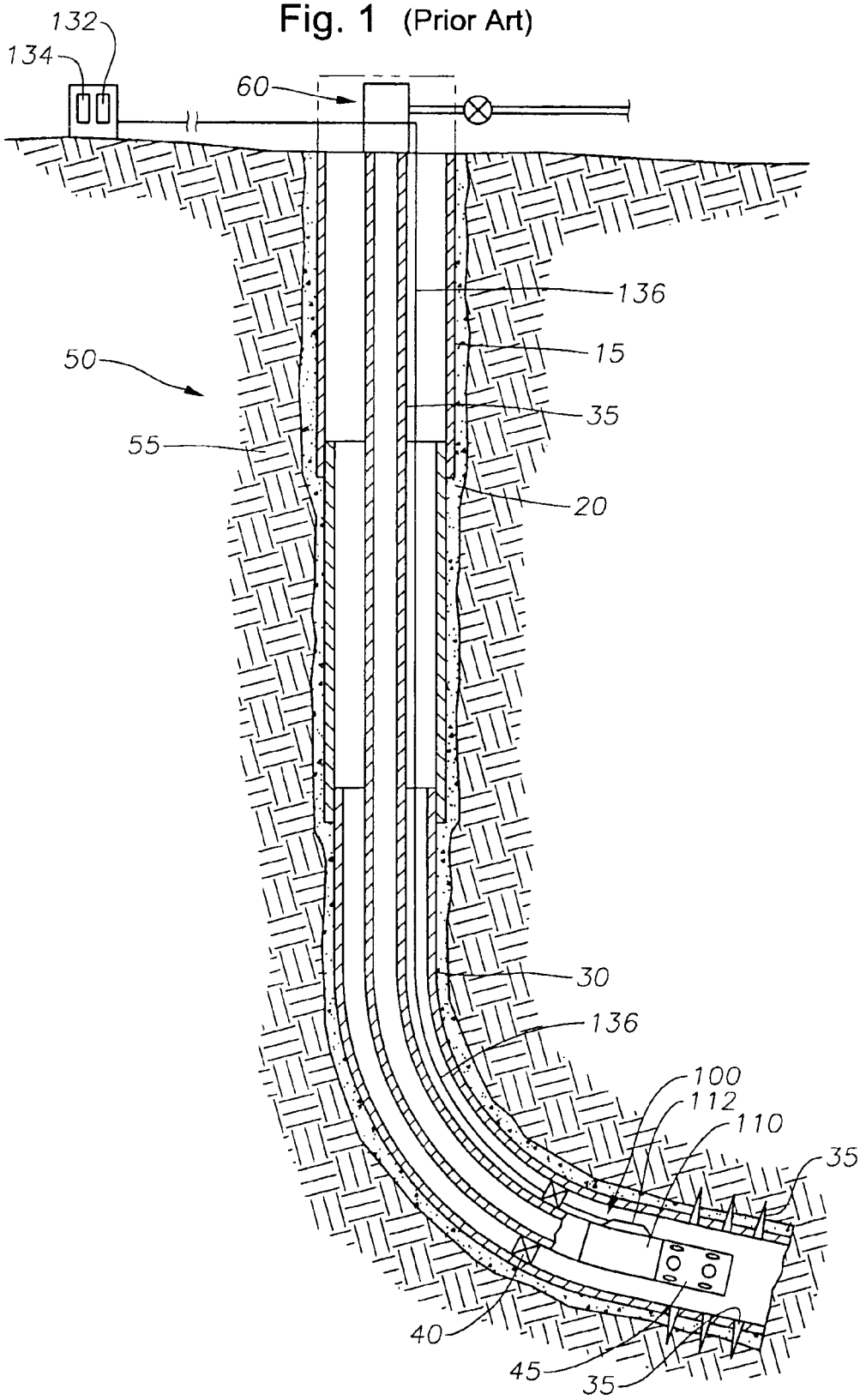
Fig. 1 (Prior Art)
FIG. 1 presents a cross-sectional view of a wellbore which has been completed for the production of hydrocarbons. A fiber optic downhole monitoring system has been deployed in the wellbore. A sensor (not seen) is residing within a side-pocket mandrel in accordance with known sub technology.
Figure 2:
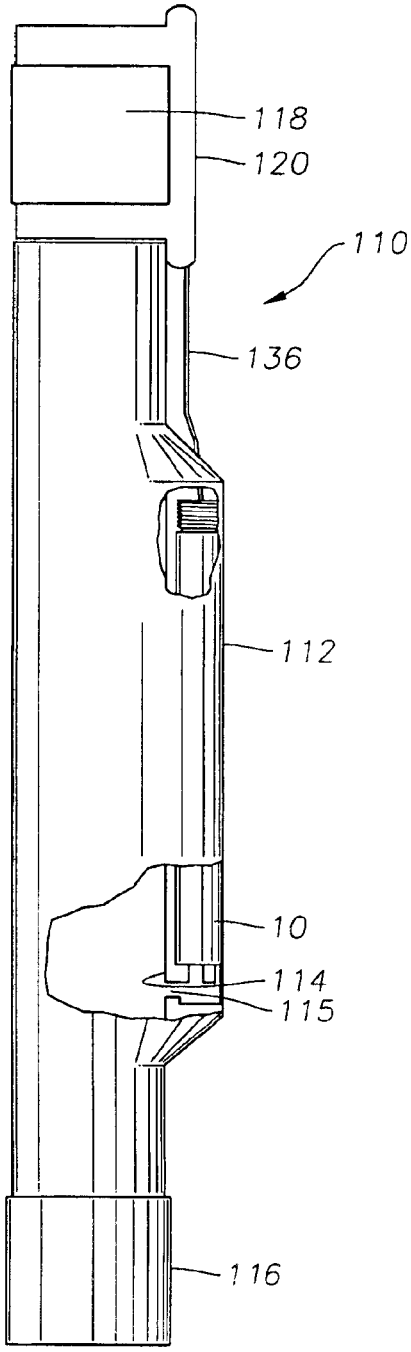
Fig. 2 (Prior Art)
FIG. 2 is an enlarged, cutaway view of a tubular mandrel known in the prior art. The mandrel includes a side pocket configured to house a fiber optic sensor, such as a pressure gauge or other sonde.

The sub 210 is preferably configured to be connectible to a string of pipe, such as a string of production tubing (seen at 55 in FIG. 1). In the particular arrangement shown in FIG. 3, the connection is a threaded connection. In addition, and in the arrangement shown in FIG. 3, clamps 212 and 214 are provided for mechanically securing and protecting the cable 220.

Figure 4:
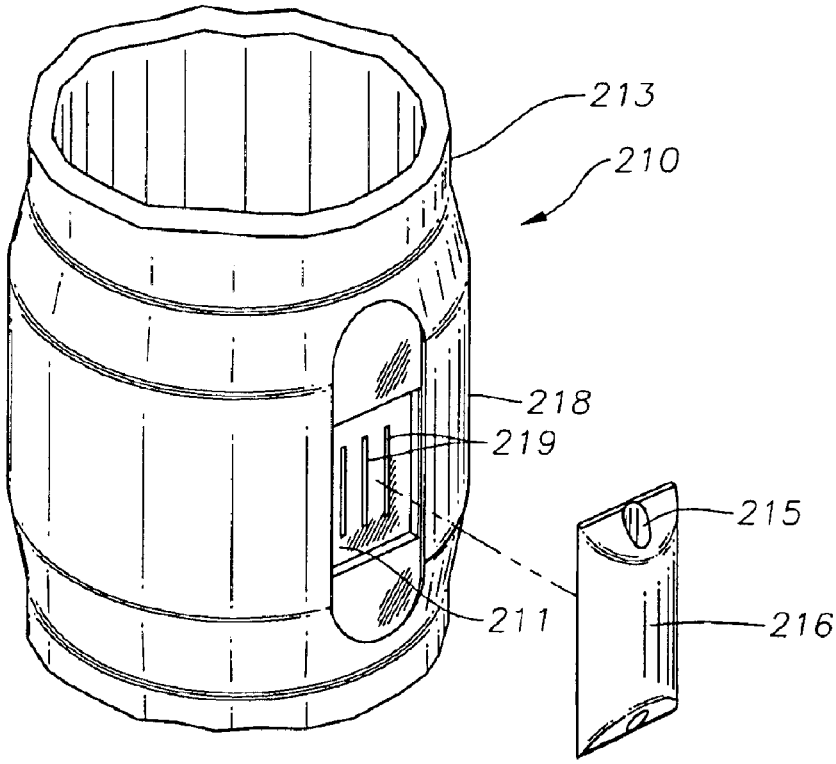
FIG. 4 provides an enlarged view of a portion of the downhole sub of FIG. 3. A gauge housing is seen exploded away from the tubular body of the sub. A recess fabricated within the enlarged outer diameter portion of the tubular body can be seen. Slots can be seen within the enlarged outer diameter portion of the tubular body.

Next, the sub 210 comprises a gauge housing 216. The gauge housing 216 attaches to the tubular body 213. In one arrangement, attachment is by means of Electron Beam (EB) welding. FIG. 4 provides an enlarged view of a portion of the downhole sub 210 of FIG. 3. The gauge housing 216 is seen exploded away from the tubular body 213 of the sub 210. A recess 211 is fabricated into the wall of the tubular body 213. In this arrangement, the gauge housing 216 is positioned against a recessed wall in the body 213 of the sub 210, with the wall having one or more ports 219. The purpose of the recess 211 is to give mechanical strength to the gauge housing 216 and to protect the gauge housing 216 from impacts during tubing installation in the well. The recess 211 also provides a buffer volume to be filled with viscous fluids (e.g., grease) to act as a pressure transmitting media to the membrane.

In the view of FIG. 4, an enlarged outer diameter portion 218 is fabricated around a portion of the tubular body 213. The enlarged outer diameter portion 218 is provided circumferentially about the tubular body 213. The enlarged outer diameter portion 218 is configured to approximate the size of the collars being used for the production tubing 55. The use of an enlarged outer diameter portion 218 aids in centralizing the sub 210 within the wellbore 50. It also assists in protecting the gauge housing 216 en route to its operating depth and provides metal thickness to allow the recess to be made for receiving the gauge housing 216.

In FIG. 4, slots 219 can be seen within the enlarged outer diameter portion 218 of the tubular body 213. The slots 219 permit fluid and pressure communication between the inner bore of the sub 210 and the gauge housing 216. The slots 219 serve as elongated ports. In one arrangement, and as shown more clearly in FIG. 8, the slots 219 have a more restricted opening proximate the inner bore of the sub 210, and expand outwardly towards the gauge housing 216. Such a slotted design inhibits the plugging of the ports 219 by debris from inside the tubing sub 210. However, any port configuration may be used. In addition, the slots 219 may define holes drilled tangentially to the tubular body 213 through the recess 211 to allow external pressure to access the sensor 10 in lieu of internal pressure.

It can also be seen in FIG. 4 that the gauge housing 216 includes a side bore 215. The side bore 215 extends the length of the gauge housing 216. As will be discussed below, the side bore 215 is dimensioned to accommodate a sensor 10 (not shown in FIG. 4).

Figure 5:
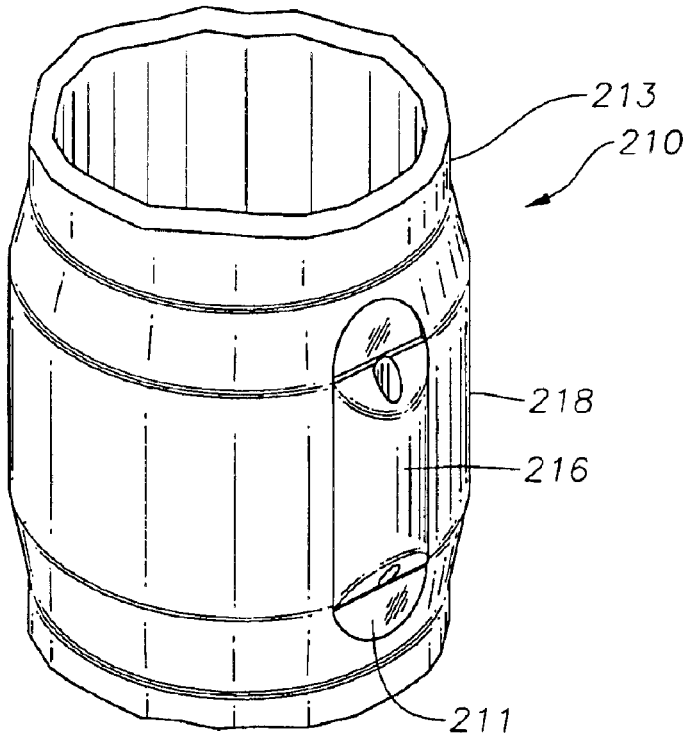
FIG. 5 presents the downhole sub of FIG. 4, with the gauge housing received within the recess of the wall of the tubular body. The portion of the downhole sub includes an enlarged outer diameter portion of the wall of the tubular body.

FIG. 5 presents the downhole sub 210 of FIG. 4, with the gauge housing 216 received within the recess 211 of the tubular body 213. The portion of the downhole sub 210 again includes an enlarged outer diameter 218 portion of the wall of the tubular body 213.

Figure 6:
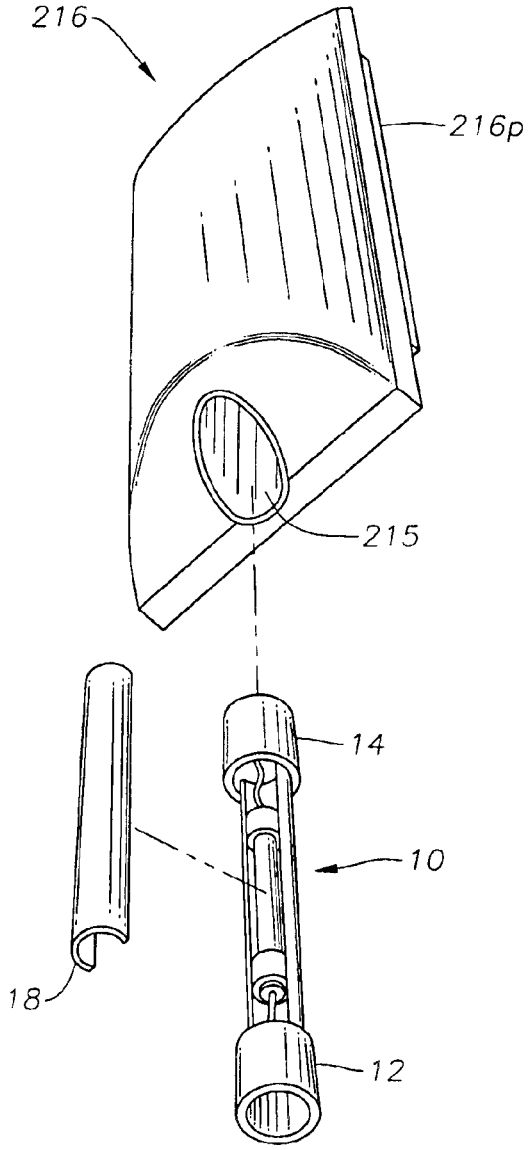
FIG. 6 presents another perspective view of the gauge housing of FIG. 5. In this view, the gauge housing is seen from the bottom. A sensor can be seen exploded from a side bore of the gauge housing. A sensor cover is also exploded away from the sensor.

Moving now to FIG. 6, FIG. 6 presents another perspective view of the gauge housing 216 of FIGS. 4 and 5. In this view, the gauge housing 216 is seen from the bottom. The side bore 215 is also visible from the bottom. A sensor 10 can now be seen exploded from the bottom of the side bore 215 of the gauge housing 216. A sensor cover 18 is also exploded away from the sensor 10. The sensor cover 18 provides only a partial covering of the sensor 10, preserving the ability of the sensor 10 to sense wellbore conditions.

It should be noted at this point that the sensor 10 has opposite ends 212, 214. These ends 212, 214 are configured to provide mechanical and signal communication between the sensor 10 and the cable 136 (not seen in FIG. 6). Typically, the connection is in the form of a pin-connection or other quick connect coupling. This affords quick connections with the surface cable 136 or with additional sensors, or with a blind plug (not shown) at the bottom connector. The sensor 10 may be either a fiber optical sensor, or may be an electrical sensor or gauge. The sensor and the connectors are inserted and EB welded to the gauge housing 216. The completed gauge housing 216 is completely sealed to the bore of the tubular body 210 by means of EB welding, and hence has neither elastomers nor metal-to-metal seals. This forms a pressure-sensitive area internal to the gauge housing 216. Where the sensor is a pressure sensor, the pressure-sensitive area is vacuum filled with a non-compressible fluid (typically silicon oil).

Figure 7:
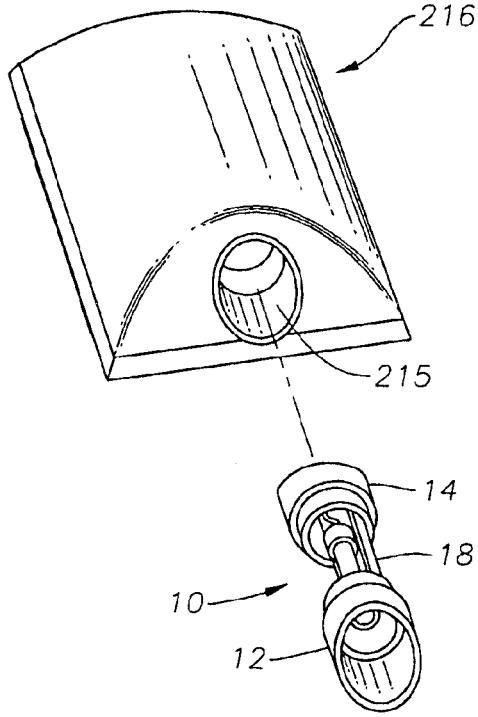
FIG. 7 provides another view of the gauge housing of FIG. 6. Here, the sensor cover is placed over the sensor.

FIG. 7 provides another view of the gauge housing 216 of FIG. 6. The gauge housing 216 is again seen from a bottom view. Here, the sensor cover 18 is placed over the sensor 10.

Figure 8:
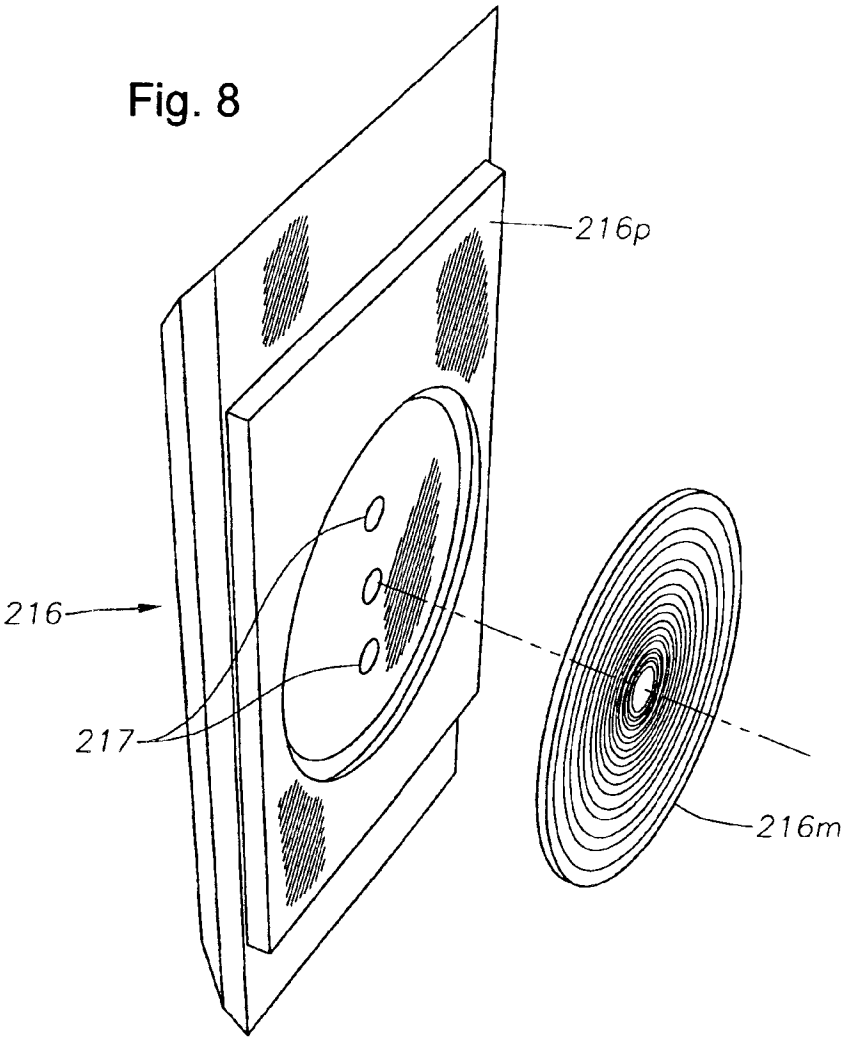
FIG. 8 presents a perspective view of the gauge housing of the downhole sub of the present invention, in one arrangement. In this view, a membrane is exploded apart from the plate of the gauge housing. Visible in this view are gauge housing ports.

FIG. 8 presents another perspective view of the gauge housing 216 of the downhole sub 210. In this view, the internal side of the gauge housing 216 is visible. The internal side of the gauge housing 216 defines a plate portion **216*p* that is exposed to fluids within the tubing 55. To this end, one or more gauge housing ports 217 are fabricated into the gauge housing 216 to enable hydraulic pressure transfer between the inner bore of the production tubing 55 and the side bore 215 of the gauge housing 216 via a metal membrane 216*m*. The plate portion 216*p* may be a flat surface. Alternatively, it may be arcuate to more closely conform to the radial dimension of the wall of the tubular body 213**.

FIG. 8 shows a membrane **216*m* above the plate portion 216*p*. The membrane 216*m* is shown exploded apart from the plate portion 216*p*. The membrane 216*m* is supported along a small ridge along the circumference of a recess in the plate portion 216*p*. The membrane 216*m* covers the ports 217, protecting them from sand or other debris that might exist in the fluid stream downhole. In one arrangement, the sensor 10 is a pressure sensor 10, and the membrane 216*m* is a non-permeable membrane that interacts with pressure from within the bore of the tubular body 210. Ample space between the membrane 216*m* and the plate 216*p* is given to allow movement needed in the pressure range of the sensor 10. The membrane 216*m*** is preferably a metal membrane, such as Monel, that accommodates the EB welding fabrication.

Figure 9:
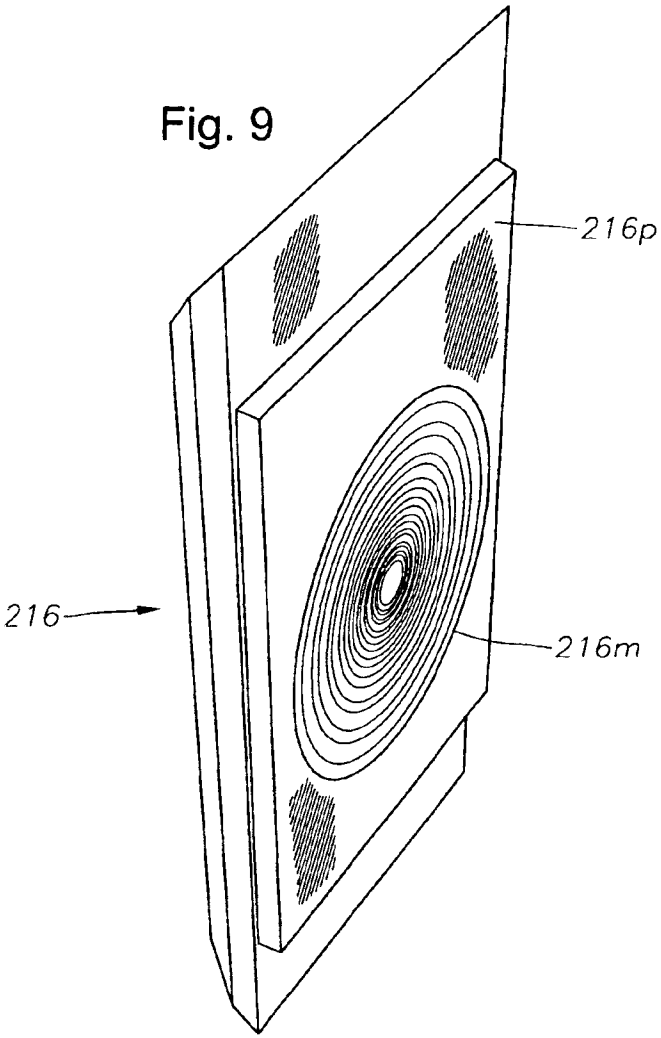
FIG. 9 shows the gauge housing of FIG. 8, with the membrane affixed to the plate of the gauge housing In the arrangement shown, the membrane is affixed by means of Electron Beam (EB) welding.

FIG. 9 shows the gauge housing of FIG. 8, with the non-permeable membrane 216*m* affixed to the plate portion 216*p* of the gauge housing 216. The membrane 216*m* is preferably welded over the ports 217 onto the gauge housing 216 by a precise process, such as electron beam welding.

Figure 10:
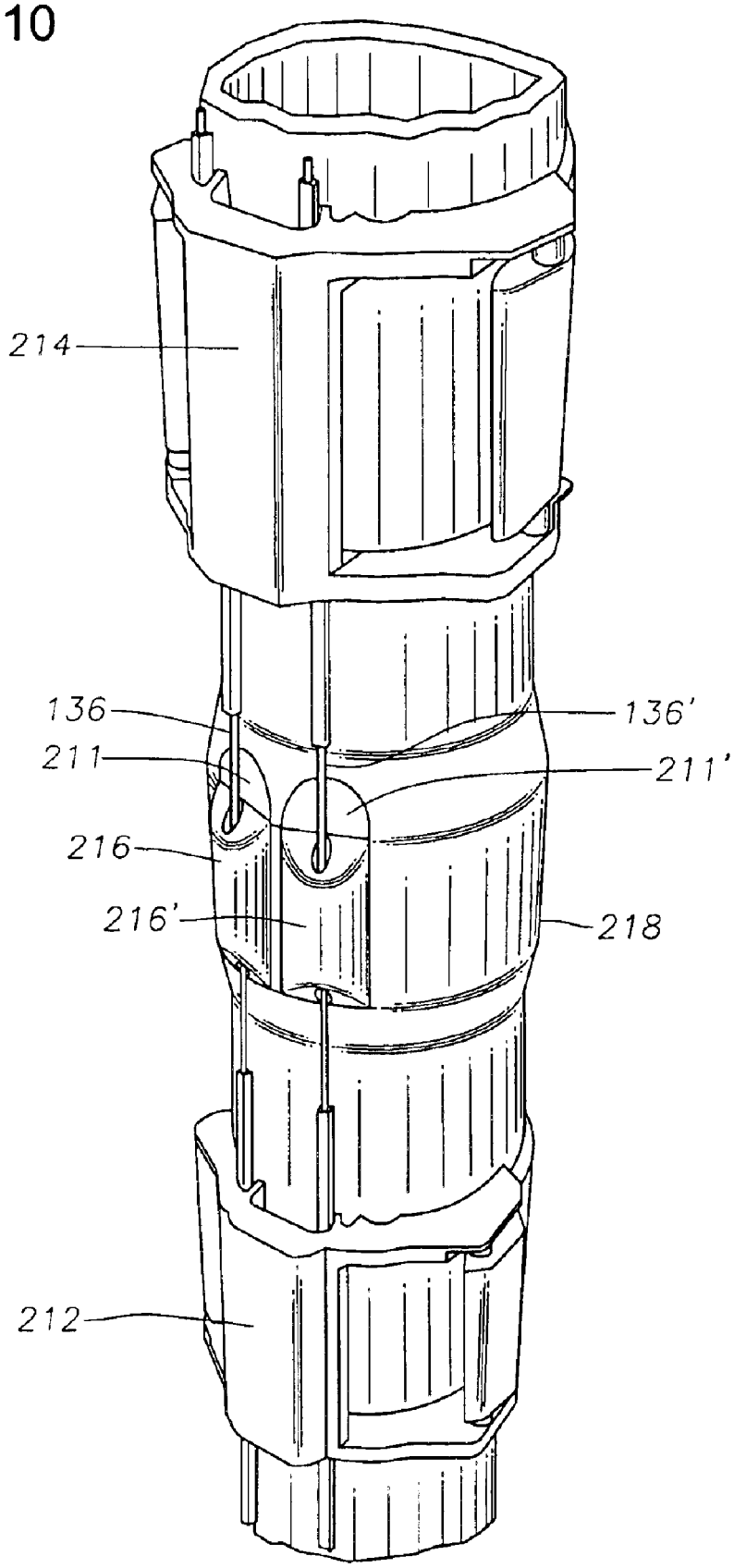
FIG. 10 provides a perspective view of an alternate arrangement for the downhole sub of the present invention. In this arrangement, dual recesses are disposed along the enlarged outer diameter portion of the body. This permits more than one gauge housing and resident sensors to be safely secured to the tubular body. This could be used for example to obtain tubing as well as annulus pressures to be monitored.

Finally, FIG. 10 provides a perspective view of an alternate arrangement for a downhole sub 210 of the present invention. In this arrangement, dual recesses 211, 211' are disposed along the enlarged outer diameter portion 218 of the body 213. This permits more than one gauge housing 216, 216' and resident sensors to be safely secured to the tubular body 213.

While the foregoing is directed to embodiments of the present invention, other and further embodiments of the invention may be devised without departing from the basic scope thereof, and the scope thereof is determined by the claims that follow.

What is claimed is:

1. A downhole sub for housing instrumentation, the sub being connectible to a string of tubing, the downhole sub comprising:

an essentially concentric tubular body, the body having a wall defining an inner surface and an outer surface, the dimensions of the inner surface of the tubular body generally conforming to the dimensions of the inner surface of the string of tubing so as to form a bore;

a recess formed within the wall of the tubular body;

a gauge housing received at least partially within the recess in the wall of the tubular body, the gauge housing having a side bore for receiving the instrumentation, and at least one port for placing the inner surface of the tubular body in hydraulic communication with the side bore; and the side bore configured to receive a cable external to the string of tubing.

2. The downhole sub of claim 1, wherein:

the gauge housing further comprises a plate portion exposed to fluids within the tubing string; and the at least one port in the gauge housing extends through the plate portion.

3. The downhole sub of claim 1, the sub further comprises an enlarged outer diameter portion circumferentially disposed along the outer surface of the tubular body;

the circumference of the enlarged outer diameter portion approximates the diameter of collars for the tubing; and wherein the recess for receiving the gauge housing is formed within the enlarged outer diameter portion.

4. The downhole sub of claim 3, wherein:

the gauge housing further comprises a plate portion opposite the side bore;

the at least one port in the gauge housing extends through the plate portion; and the at least one recess in the enlarged outer diameter portion of the tubular body receives the plate portion of the respective gauge housing.

5. The downhole sub of claim 4, wherein the tubular body and the gauge housing are attached by means of electron beam welding.

6. The downhole sub of claim 5, wherein:

the instrumentation is a pressure sensor; and the gauge housing further comprises a non-permeable membrane disposed between the plate portion of the gauge housing and the bore of the tubular sub, a pressure-responsive area being formed between the membrane and the plate portion, and with a non-compressible fluid being placed in the pressure-responsive area.

7. The downhole sub of claim 3, wherein the instrumentation transmits a signal over an electrical line.

8. The downhole sub of claim 3, wherein the instrumentation transmits a signal over a fiber optic line.

9. A downhole sub for housing a sensor, the downhole sub comprising:

an essentially concentric tubular body, the body having a wall defining an inner surface and an outer surface;

at least one recess formed within the outer surface of the wall of the tubular body;

at least one gauge housing received within a respective recess in the outer surface of the wall of the tubular body, each of the at least one gauge housings having a side bore for receiving a sensor, and at least one port for placing the inner surface of the tubular body in hydraulic communication with the respective side bores; and the side bore configured to receive a cable external to the tubular body.

10. The downhole sub of claim 9, wherein:

the tubular body is placed in series with a string of production tubing, the production tubing having an inner diameter; and the tubular body has an inner diameter that generally conforms to the inner diameter of the production tubing.

11. The downhole sub of claim 10, wherein there are two recesses formed within the outer surface of the wall of the tubular body, and two corresponding gauge housings.

12. The downhole sub of claim 10, the sub further comprising an enlarged outer diameter portion circumferentially disposed along the outer surface of the tubular body;

the circumference of the enlarged outer diameter portion approximates the diameter of collars for the tubing; and wherein the at least one recess for receiving the respective at least one gauge housing is formed within the enlarged outer diameter portion.

13. The downhole sub of claim 12, wherein:

each of the at least one gauge housings further comprise a plate portion exposed to fluids within the production string; and the at least one port in the respective gauge housings extends through the plate portion.

14. The downhole sub of claim 10, wherein the instrumentation transmits a signal over an electrical line.

15. The downhole sub of claim 10, wherein the instrumentation transmits a signal over a fiber optic line.

16. The downhole sub of claim 10, wherein the tubular body and the gauge housing are attached by means of electron beam welding.

17. A downhole sub for housing a sensor, the downhole sub comprising:

an essentially concentric tubular body, the body having a wall defining an inner surface and an outer surface;

at least one recess formed within the outer surface of the wall of the tubular body;

at least one gauge housing received within a respective recess in the wall of the tubular body, each of the at least one gauge housings having a side bore for receiving a sensor;

at least one port in the respective gauge housings for placing the outer surface of the tubular body in hydraulic communication with the sensor in the respective side bores so as to measure a condition downhole external to the gauge housing; and the side bore configured to receive a cable external to the string of tubing.

18. The downhole sub of claim 17, wherein the sensor is a pressure sensor, and measures external pressure.

* * * * *